US011965309B2

(12) United States Patent
Hou et al.

(10) Patent No.: US 11,965,309 B2
(45) Date of Patent: Apr. 23, 2024

(54) LEVELING CONTROL METHOD, DEVICE AND SYSTEM, AND MOTOR GRADER

(71) Applicant: JIANGSU XCMG CONSTRUCTION MACHINERY RESEARCH INSTITUTE LTD., Jiangsu (CN)

(72) Inventors: Zhiqiang Hou, Xuzhou (CN); Bin Zhao, Xuzhou (CN); Hao Liu, Xuzhou (CN); Shengli Lu, Xuzhou (CN)

(73) Assignee: JIANGSU XCMG CONSTRUCTION MACHINERY RESEARCH INSTITUTE LTD., Jaingsu (CN)

( * ) Notice: Subject to any disclaimer, the term of this patent is extended or adjusted under 35 U.S.C. 154(b) by 935 days.

(21) Appl. No.: 16/941,783

(22) Filed: Jul. 29, 2020

(65) Prior Publication Data

US 2021/0372081 A1 Dec. 2, 2021

(30) Foreign Application Priority Data

May 28, 2020 (CN) ..... 202010468500.3

(51) Int. Cl.
*E02F 3/84* (2006.01)
*E02F 3/76* (2006.01)

(52) U.S. Cl.
CPC ..... *E02F 3/842* (2013.01); *E02F 3/764* (2013.01); *E02F 3/847* (2013.01)

(58) Field of Classification Search
CPC ..... E02F 3/847; E02F 3/7627; E02F 3/7609; E02F 3/7613; E02F 3/7631; E02F 9/262;
(Continued)

(56) References Cited

U.S. PATENT DOCUMENTS 5,612,864 A * 3/1997 Henderson ..... G01S 19/44 356/3.01
5,646,844 A * 7/1997 Gudat ..... G05D 1/0278 701/50

(Continued)

FOREIGN PATENT DOCUMENTS

CN 101117809 A 2/2008
CN 206205021 U 5/2017

(Continued)

OTHER PUBLICATIONS

First Office Action dated Jun. 10, 2021 in corresponding Chinese Application No. 202010468500.3., with English Translation, 28 pages.

(Continued)

*Primary Examiner* — Edwin J Toledo-Duran
(74) *Attorney, Agent, or Firm* — Myers Bigel, P.A.

(57) ABSTRACT

The present disclosure relates to a leveling control method, device and system, a motor grader. The leveling control method includes: acquiring elevations of a current position of a blade of a motor grader and a target position, and a movement speed of the motor grader, wherein the target position is on the ground with a certain horizontal distance from the current position along a movement direction of the motor grader; determining a movement time of the blade from the current position to the target position from the horizontal distance and the movement speed; determining a lifting speed of a lifting cylinder from an elevation difference between the elevation of the target position and the elevation of the current position and the movement time; and controlling the lifting cylinder to adjust the blade to move from the current position to the target position according to the lifting speed.

17 Claims, 7 Drawing Sheets

(58) Field of Classification Search
CPC . E02F 3/844; E02F 3/842; E02F 3/764; E02F 3/76; E02F 3/80; E02F 3/815; E02F 3/8152; E02F 3/84; E02F 3/848; G01S 19/49
See application file for complete search history.

(56) References Cited

U.S. PATENT DOCUMENTS 5,964,298 A * 10/1999 Greenspun ..... E02F 3/842 172/811
5,987,371 A * 11/1999 Bailey ..... E02F 3/847 701/472
6,068,060 A * 5/2000 Ohtomo ..... G01C 15/004 701/50
6,112,143 A * 8/2000 Allen ..... G05D 1/0221 701/445
6,286,607 B1 * 9/2001 Ohtomo ..... G01C 15/004 356/147
7,161,254 B1 * 1/2007 Janky ..... H02K 35/02 290/1 R
8,655,556 B2 * 2/2014 Hayashi ..... E02F 3/847 37/235
10,392,774 B2 * 8/2019 Dauderman ..... E02F 9/226
10,533,301 B1 * 1/2020 Armas ..... E02F 3/7618
2001/0023766 A1 * 9/2001 Ohtomo ..... G05D 1/0272 701/50
2001/0029417 A1 * 10/2001 Phelps ..... E02F 3/845 701/50
2002/0162668 A1 * 11/2002 Carlson ..... E02F 9/26 172/1
2003/0137658 A1 * 7/2003 Ohtomo ..... G01C 15/004 356/141.4
2006/0033657 A1 * 2/2006 Lawrence ..... H01Q 1/1257 342/357.37
2007/0284121 A1 * 12/2007 Montgomery ..... E02F 3/847 172/2
2008/0000659 A1 * 1/2008 Zachman ..... E02F 3/845 172/797
2008/0015811 A1 * 1/2008 Conner ..... G01C 15/002 702/159
2009/0056961 A1 * 3/2009 Gharsalli ..... E02F 3/844 172/779
2009/0069987 A1 * 3/2009 Omelchenko ..... E02F 9/2045 701/50
2010/0121540 A1 * 5/2010 Kumagai ..... G01S 5/163 701/50
2012/0279735 A1 * 11/2012 Ditzler ..... E02F 3/815 172/825
2013/0081836 A1 * 4/2013 Hayashi ..... E02F 9/264 172/822
2013/0085644 A1 * 4/2013 Hayashi ..... E02F 3/847 701/50
2013/0087349 A1 * 4/2013 Hayashi ..... E02F 3/847 701/50
2013/0096819 A1 * 4/2013 Tarnok ..... G01C 21/3844 701/538
2013/0151086 A1 * 6/2013 Shockency, Jr. ..... B60T 8/172 701/50
2013/0282224 A1 * 10/2013 Yazaki ..... A01D 34/008 701/24
2014/0257646 A1 * 9/2014 Ishibashi ..... E02F 3/7618 701/50
2014/0277956 A1 * 9/2014 Morin ..... G01C 21/20 701/50
2014/0345889 A1 * 11/2014 Nakata ..... E02F 3/847 172/1
2015/0019086 A1 * 1/2015 Hayashi ..... E02F 3/844 172/4
2016/0122969 A1 * 5/2016 Noborio ..... E02F 9/262 701/50
2018/0216315 A1 8/2018 Benson et al.
2018/0258610 A1 * 9/2018 Elkins ..... B60W 10/20
2018/0340315 A1 * 11/2018 Metzger ..... E02F 3/845
2019/0204440 A1 * 7/2019 Beckhaus ..... E02F 5/145
2020/0040549 A1 * 2/2020 Armas ..... E02F 3/8157
2020/0048870 A1 * 2/2020 Peat ..... E02F 3/764
2021/0015022 A1 * 1/2021 Hall ..... A01B 63/111
2022/0135243 A1 * 5/2022 Arnold ..... B64D 43/00 701/3

FOREIGN PATENT DOCUMENTS

CN 108086373 A 5/2018
CN 110056026 A * 7/2019 ..... E02F 3/76
CN 110056026 A 7/2019
CN 110258686 A 9/2019
CN 110374154 A 10/2019
CN 111576514 A 8/2020

OTHER PUBLICATIONS

International Search Report for corresponding PCT Application No. PCT/CN2021/089906 (including English translation of the ISR), dated Jul. 20, 2021, 13 pages.

* cited by examiner

LEVELING CONTROL METHOD, DEVICE AND SYSTEM, AND MOTOR GRADER

CROSS-REFERENCE TO RELATED APPLICATIONS

This present disclosure is based on and claims priority to Chinese application for invention No. 202010468500.3, filed on May 28, 2020, the disclosure of which is hereby incorporated into this disclosure by reference in its entirety.

TECHNICAL FIELD

The present disclosure relates to the field of construction machinery, in particular to a leveling control method, device and system, a motor grader and a computer storable medium.

BACKGROUND

The motor grader is an earth moving construction machine which uses a blade as a main body and cooperates with other various replaceable operation devices to carryout a soil shoveling, leveling or shaping operation. The motor grader is mainly applied to large-area leveling operations of soil such as roads, airports, farmlands, water conservancy and the like, and construction operation scenes such as slope scraping, ditching, bulldozing, soil loosening, road ice and snow clearing and the like. The motor grader is one of important equipment in national defense construction, traffic and water conservancy basic construction, and plays a great role in national economic construction.

In order to ensure construction flatness while greatly reducing the labor intensity of an operator and improving the construction efficiency, the addition of a blade automatic elevation control function to the motor grader is an effective solution.

At present, there are mainly two types of leveling control systems for the motor grader: one is a laser-based leveling control System, and the other is a GPS (Global Positioning System)-based three-dimensional leveling system. The GPS has advantages of high precision and all-weather measurement, and can accurately detect the elevation of the blade in the leveling process of the motor grader to realize a precise leveling operation of the road surface. Accordingly, GPS is typically utilized in the leveling control systems of the motor grader to detect the elevation of the blade.

In the related art, the GPS is arranged at both ends of the blade of the motor grader to acquire the elevation of the blade in real time, which is compared with a preset elevation of the earth's surface, to adjust a lifting cylinder in real time according to a difference obtained through the comparison, so as to realize the control of the elevation of the blade.

SUMMARY

According to a first aspect of the present disclosure, there is provided a leveling control method, comprising: respectively acquiring an elevation of a current position of a blade of a motor grader, an elevation of a target position, and a movement speed of the motor grader, wherein the target position is on the ground with a certain horizontal distance from the current position along a movement direction of the motor grader; determining a movement time of the blade from the current position to the target position according to the horizontal distance and the movement speed; determining a lifting speed of a lifting cylinder according to an elevation difference between the elevation of the target position and the elevation of the current position and the movement time; and controlling the lifting cylinder to adjust the blade to move from the current position to the target position according to the lifting speed.

In some embodiments, acquiring an elevation of a target position comprises: respectively acquiring an elevation of a Global Positioning System (GPS) and a vertical distance between the GPS and the target position, wherein the GPS is fixedly arranged relative to a frame of the motor grader; and acquiring the elevation of the target position according to the elevation of the GPS and the vertical distance between the GPS and the target position.

In some embodiments, acquiring a vertical distance between the GPS and the target position comprises: acquiring a vertical distance between a distance sensor and the target position, wherein the distance sensor is fixedly arranged relative to the frame of the motor grader; acquiring a vertical distance between the GPS and the distance sensor; and acquiring the vertical distance between the GPS and the target position according to the vertical distance between the distance sensor and the target position and the vertical distance between the GPS and the distance sensor.

In some embodiments, the distance sensor is located directly above the target position, and acquiring a vertical distance between a distance sensor and the target position comprises: acquiring a detection value obtained by the distance sensor through detecting the ground; and acquiring the vertical distance between the distance sensor and the target position according to the detection value.

In some embodiments, the distance sensor is an ultrasonic sensor or a lidar sensor, and acquiring the vertical distance between the distance sensor and the target position according to the detection value comprises: determining the detection value as the vertical distance between the distance sensor and the target position in the case that the distance sensor is the ultrasonic sensor; and determining a product of the detection value and a cosine value of a laser emission angle of the lidar sensor as the vertical distance between the distance sensor and the target position in the case that the distance sensor is the lidar sensor.

In some embodiments, acquiring an elevation of a current position of a blade of a motor grader comprises: acquiring an elevation of a Global Positioning System (GPS), wherein the GPS is fixedly arranged relative to a frame of the motor grader; and acquiring the elevation of the current position of the blade of the motor grader according to the elevation of the GPS.

In some embodiments, the GPS is located directly above the blade, and acquiring the elevation of the current position of the blade of the motor grader according to the elevation of the global positioning system (GPS) comprises: determining an elevation of a projection point of the GPS on the ground according to a distance between the GPS and the projection point of the GPS on the ground and the elevation of the GPS; and determining the elevation of the current position of the blade according to the elevation of the projection point of the GPS on the ground and a shovel angle of the current position of the blade.

In some embodiments, the current position comprises a position of a first edge angle and a position of a second edge angle of the blade, respectively.

According to a second aspect of the present disclosure, there is provided a leveling control device, comprising: an acquiring module configured to respectively acquire an elevation of a current position of a blade of a motor grader, an elevation of a target position, and a movement speed of the motor grader, wherein the target position is on the ground with a certain horizontal distance from the current position along a movement direction of the motor grader; a first determining module configured to determine a movement time of the blade from the current position to the target position according to the horizontal distance and the movement speed; a second determining module configured to determine a lifting speed of a lifting cylinder according to an elevation difference between the elevation of the target position and the elevation of the current position and the movement time; and a controlling module configured to control the lifting cylinder to adjust the blade to move from the current position to the target position according to the lifting speed.

According to a third aspect of the present disclosure, there is provided a leveling control device, comprising: a memory; and a processor coupled to the memory, the processor configured to perform the leveling control method according to any of the above embodiments based on instructions stored in the memory.

According to a fourth aspect of the present disclosure, there is provided a leveling control system comprising: the leveling control device according to any of the above embodiments.

In some embodiments, the leveling control system further comprises: a speed sensor arranged on any wheel of the motor grader and configured to measure a movement speed of the motor grader; and a Global Positioning System (GPS) fixedly arranged relative to a frame of the motor grader and configured to measure an elevation of the GPS; and a distance sensor fixedly arranged relative to a frame of the motor grader and configured to detect the ground to get a detection value.

In some embodiments, the GPS and the distance sensor are fixedly arranged relative to the frame of the motor grader by a first bracket and a second bracket, respectively.

In some embodiments, the GPS is located directly above the blade, and the distance sensor is spaced apart from the blade by a certain distance along the movement direction of the motor grader.

In some embodiments, the first bracket is perpendicular to a horizontal plane and the second bracket is parallel to the horizontal plane.

In some embodiments, the GPS comprises a first GPS and a second GPS, respectively located directly above the blade on both sides in a width direction of a body of the motor grader; and the distance sensor comprises a first distance sensor and a second distance sensor respectively spaced apart from the both sides along the movement direction of the motor grader by a certain distance, and the first distance sensor and the first GPS are both located on one sides of the both sides, and the second distance sensor and the second GPS are both located on the other side of the both sides.

According to a fifth aspect of the present disclosure, there is provided a motor grader comprising: the leveling control system according to any of the above embodiments.

According to a sixth aspect of the present disclosure, there is provided a non-transitory computer storable medium having stored thereon computer program instructions which, when executed by a processor, implement the leveling control method according to any of the above embodiments.

BRIEF DESCRIPTION OF THE DRAWINGS

The accompanying drawings, which are incorporated in and constitute a part of this specification, illustrate embodiments of the present disclosure and together with the description, serve to explain the principles of the present disclosure.

The present disclosure may be more clearly understood from the following detailed description taken in conjunction with the accompanying drawings, in which.

DETAILED DESCRIPTION

Figure 1:
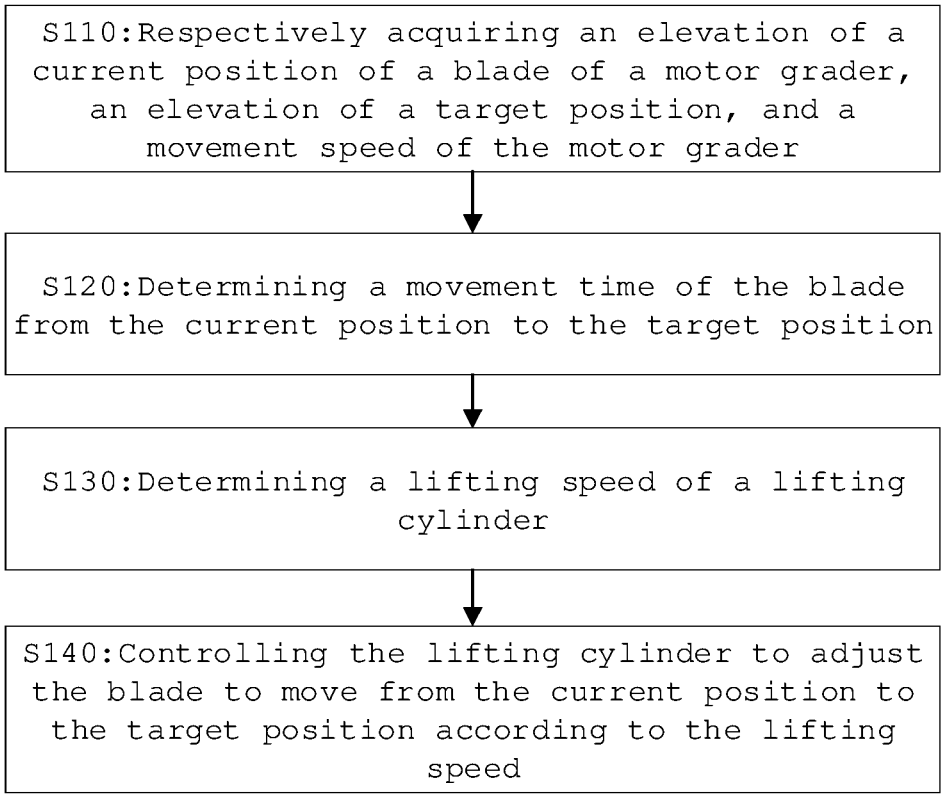
FIG. 1 is a flowchart illustrating a leveling control method according to some embodiments of the present disclosure.

Various exemplary embodiments of the present disclosure will now be described in detail with reference to the accompanying drawings. It should be noted that: relative arrangements of parts and steps, numerical expressions and numerical values set forth in these embodiments do not limit the scope of the present disclosure unless specifically stated otherwise.

Meanwhile, it should be understood that the sizes of the respective portions shown in the drawings are not drawn in an actual proportional relationship for the convenience of description.

The following description of at least one exemplary embodiment is merely illustrative in nature and is in no way intended to limit the present disclosure, its applications, or uses.

Techniques, methods, and apparatus known to one of ordinary skill in the related art may not be discussed in detail but are intended to be part of the specification where appropriate.

In all examples shown and discussed herein, any particular value should be construed as exemplary only and not as restrictive. Thus, other examples of the exemplary embodiments may have different values.

It should be noted that: like reference numbers and letters refer to like items in the following drawings, and thus, once an item is defined in one drawing, it need not be discussed further in subsequent drawings.

In the related art, a hydraulic system of the motor grader has hysteresis, i.e., a certain time is required from the acquisition of the elevation of the blade to the actual adjustment of the blade to a preset elevation. However, the motor grader always operates at a certain speed, and the horizontal position of the blade has changed when the blade is adjusted to the preset elevation, resulting a poor leveling accuracy.

In view of this, the present disclosure provides a leveling control method, which improves leveling accuracy.

FIG. 1 is a flow chart illustrating a leveling control method according to some embodiments of the present disclosure.

Figure 2:
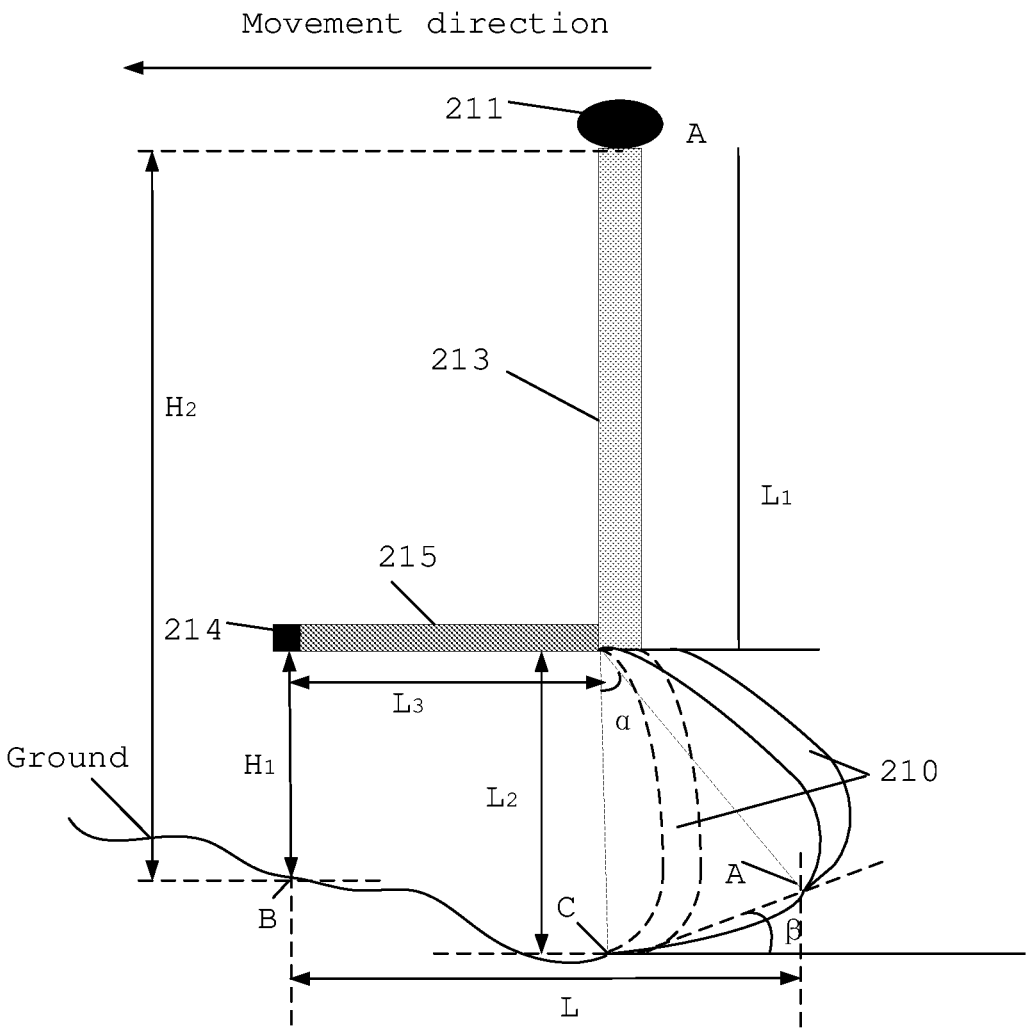
FIG. 2 is a schematic diagram illustrating a side view of a leveling control system according to some embodiments of the present disclosure.

FIG. 2 is a schematic diagram illustrating a side view of a leveling control system according to some embodiments of the present disclosure.

Figure 3A:
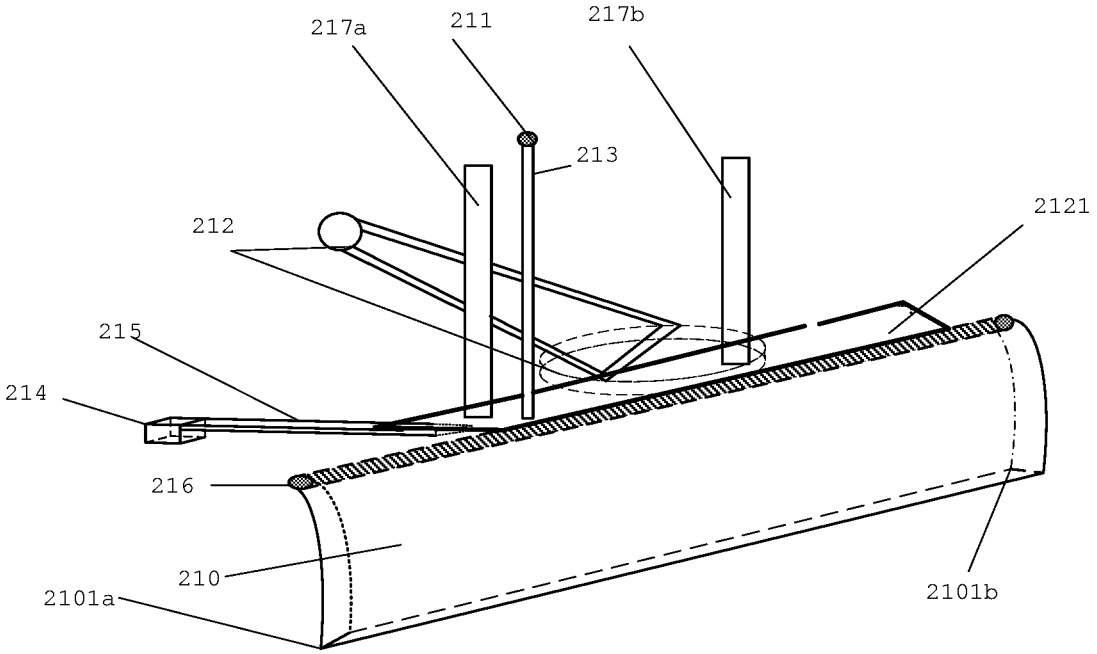
FIG. 3*a* is a schematic diagram illustrating a structure of a leveling control system according to some embodiments of the present disclosure.

FIG. 3*a* is a schematic diagram illustrating a structure of a leveling control system according to some embodiments of the present disclosure.

Figure 3B:
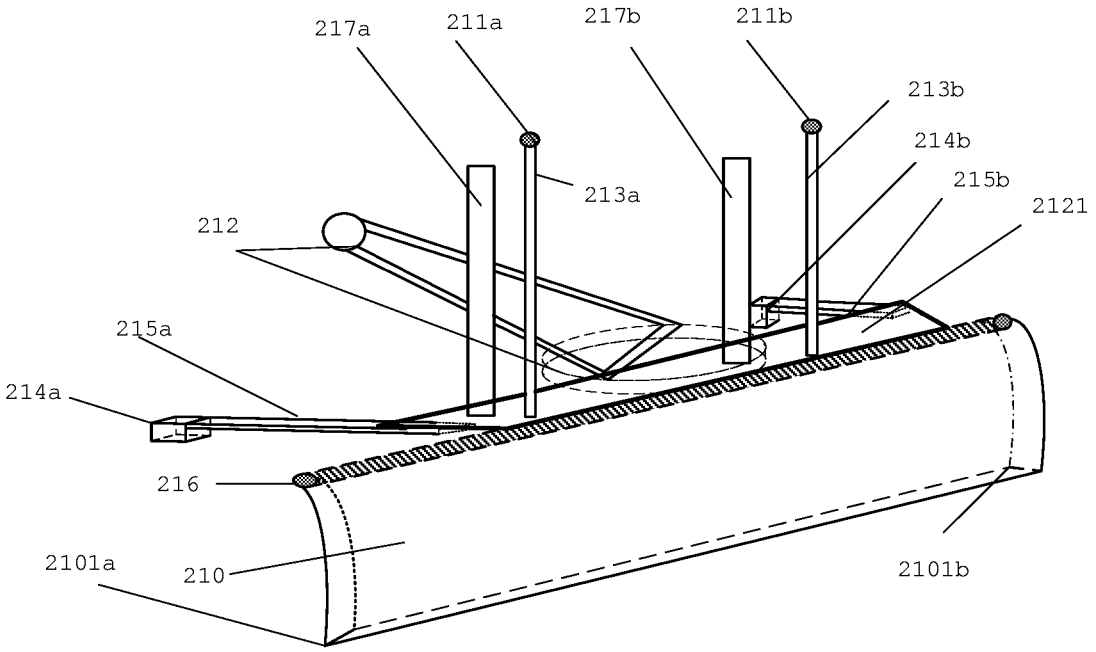
FIG. 3*b* is a schematic diagram illustrating a structure of a leveling control system according to some other embodiments of the present disclosure.

FIG. 3*b* is a schematic diagram illustrating a structure of a leveling control system according to some other embodiments of the present disclosure.

As shown in FIG. 1, the leveling control method comprises step S110: respectively acquiring an elevation of a current position of a blade of a motor grader, an elevation of a target position and a movement speed of the motor grader; step S120: determining a movement time of the blade from the current position to the target position; step S130: determining a lifting speed of a lifting cylinder; and step S140: controlling the lifting cylinder to adjust the blade to move from the current position to the target position according to the lifting speed. For example, the motor grader includes, but is not limited to, construction motor grader and agricultural motor grader.

In the present disclosure, the lifting speed of the blade is determined according to the elevation of the current position of the blade, the elevation of the target position and the movement speed of the motor grader, so that when the blade of the motor grader moves horizontally from the current position to the target position, the elevation of the blade changes from the elevation of the current position to the elevation of the target position, and the elevation of the blade keeps consistent with the actual elevation of the target position, which realizes the accurate control of the elevation of the blade, improves the leveling accuracy, and reduces an error between the adjusted elevation of the blade and an actual elevation of the ground position caused by the hysteresis of the hydraulic system.

In step S110, the elevation of the current position of the blade of the motor grader, the elevation of the target position, and the movement speed of the motor grader are acquired, respectively. The target position is on the ground with a certain horizontal distance from the current position along a movement direction of the motor grader. For example, in FIG. 2, the current position of the blade 210 is A and the target position is B. The horizontal distance between A and B is denoted L. A shovel angle of the blade 210 at the current position A is $\beta$.

The process of acquiring the elevation of the target position will be described in detail below with reference to FIGS. 4*a*, 4*b*, and 4*c*.

Figure 4A:
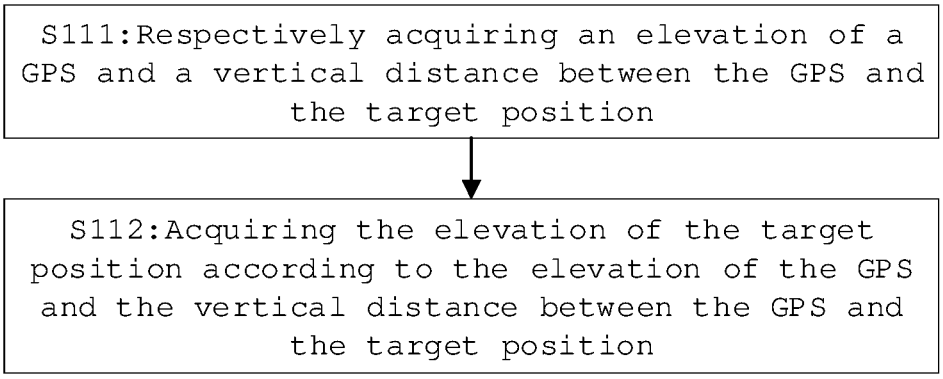
FIG. 4*a* is a flow chart illustrating acquiring an elevation of a target position according to some embodiments of the present disclosure.

FIG. 4*a* is a flow chart illustrating acquiring an elevation of a target position according to some embodiments of the present disclosure.

Figure 4B:
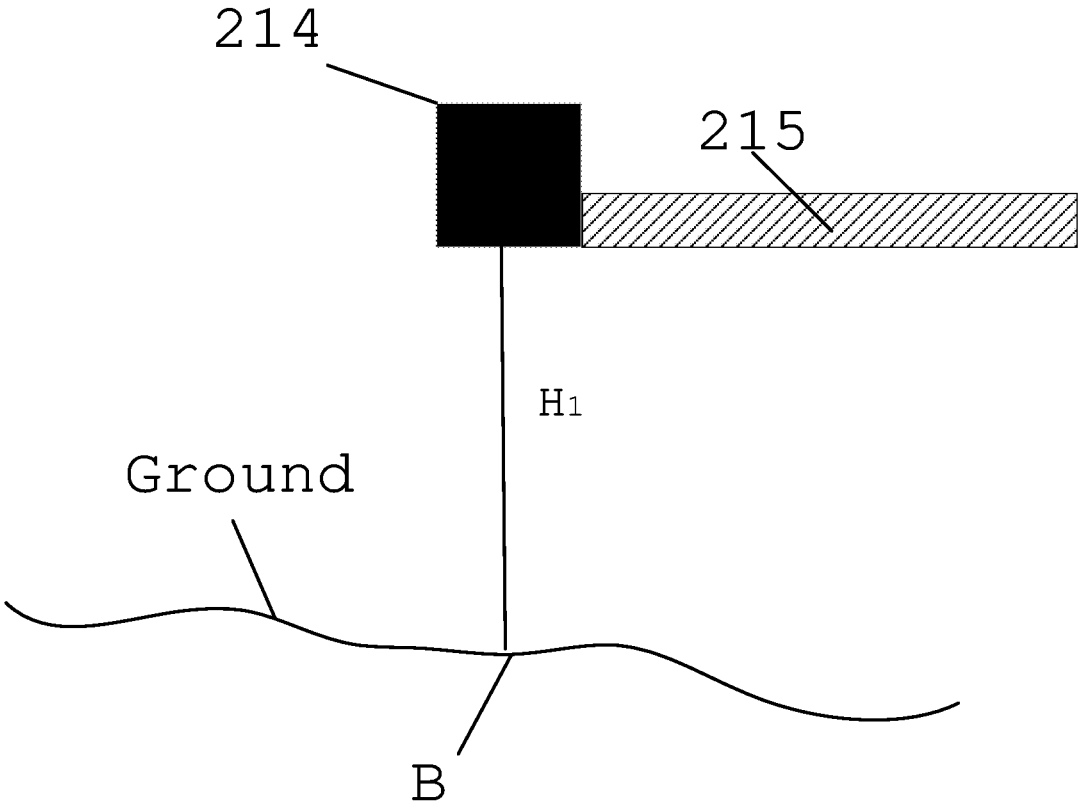
FIG. 4*b* is a schematic diagram illustrating acquiring a vertical distance between a distance sensor and the target position according to some embodiments of the present disclosure.

FIG. 4*b* is a schematic diagram illustrating acquiring a vertical distance between a distance sensor and the target position according to some embodiments of the present disclosure.

Figure 4C:
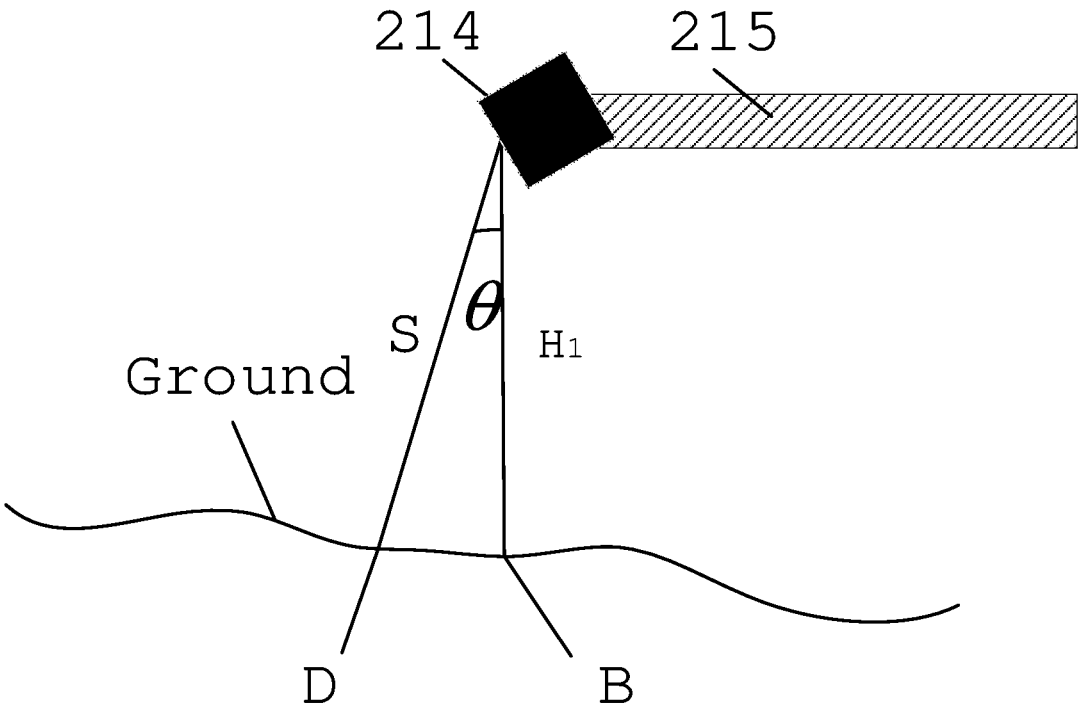
FIG. 4*c* is a schematic diagram illustrating acquiring a vertical distance between a distance sensor and the target position according to some other embodiments of the present disclosure.

FIG. 4*c* is a schematic diagram illustrating acquiring a vertical distance between a distance sensor and the target position according to some other embodiments of the present disclosure.

As shown in FIG. 4*a*, that acquiring the elevation of the target position comprises steps S111 and S112.

In step S111, an elevation of GPS and a vertical distance between the GPS and the target position are acquired, respectively. For example, the GPS is a GPS receiver.

In some embodiments, the elevation of the GPS is a measurement $Z_{GPS}$ of the GPS. For example, the GPS 211 in FIG. 3*a* is fixedly arranged relative to a frame 212 of the motor grader. In some embodiments, in FIG. 3*a*, the GPS 211 is fixedly arranged relative to the frame 212 of the motor grader via a first bracket 213.

The step S111 of acquiring the vertical distance between the GPS and the target position, shown in FIG. 4*a*, is achieved for example in the following manner.

First, a vertical distance between the distance sensor and the target position is acquired. For example, in FIG. 2, the distance sensor 214 is located directly above the target position B. In FIG. 3*a*, the distance sensor 214 is fixedly arranged relative to the frame 212 of the motor grader. In some embodiments, in FIG. 3*a*, the distance sensor 214 is separated apart from the blade 210 by a certain distance along the movement direction of the motor grader. The distance may be set empirically. The vertical distance between the distance sensor and the target position is the distance between the distance sensor and the target position.

For example, the distance sensor is an ultrasonic sensor or a lidar sensor.

In the case that the distance sensor is an ultrasonic sensor, the detection value is determined as the vertical distance between the distance sensor and the target position.

For example, in FIG. 4*b*, the distance sensor 214 is an ultrasonic sensor. The position of the ground detected by the ultrasonic sensor is the target position B. The vertical distance $H_1$ between the ultrasonic sensor and the target position B is the detection value. In some embodiments, the distance sensor 214 is fixedly disposed at an end of a second bracket 215.

In the case that the distance sensor is a lidar sensor, a product of the detection value and a cosine value of a laser emission angle of the lidar sensor is determined as the vertical distance between the distance sensor and the target position.

For example, in FIG. 4*c*, the distance sensor 214 is a lidar sensor. The position of the ground detected by the lidar sensor is a detection position D with a certain horizontal distance from the target position B on the ground. The detection value is a distance S between the lidar sensor and the detection position D. In some embodiments, the laser emission angle of the lidar sensor is $\theta$. The laser emission angle is also referred to as a detection angle. In some embodiments, the distance sensor 214 is fixedly disposed at an end of the second bracket 215.

Under the condition that the laser emission angle is within a certain range, a triangle formed by a connecting line between the lidar sensor and the detection position D, a connecting line between the lidar sensor and the target position B and a connecting line between the target position B and the detection position D can be approximately regarded as a right-angled triangle. According to the cosine law of the right-angled triangle, the vertical distance $H_1$ between the distance sensor and the target position is $S \times \cos \theta$. The lidar sensor is more accurate when being used in a secondary levelling scene.

Then, after the vertical distance between the distance sensor and the target position is acquired, the vertical distance between the GPS and the distance sensor is acquired.

In some embodiments, in FIG. 3*a*, the distance sensor 214 is fixedly arranged relative to the frame 212 of the motor grader. The GPS 211 is located directly above the blade 210.

For example, in FIG. 2 or 3*a*, the first bracket 213 is perpendicular to the horizontal plane and the second bracket 215 is parallel to the horizontal plane. In some embodiments, in FIG. 2 or 3*a*, the GPS 211 is disposed at an end of the first bracket 213 away from the blade 210, and the distance sensor 214 is disposed at an end of the second bracket 215 away from the blade 210. The first bracket 213 has a length $L_1$. In this case, the vertical distance between the GPS and the distance sensor is $L_1$. As will be appreciated by those skilled in the art, the horizontal plane in the present disclosure is a reference plane for measuring the elevation.

For example, in FIG. 3*a*, the frame 212 of the motor grader includes a third bracket 2121. The third bracket 2121 is located directly above the blade 210, in parallel with an upper edge of the blade 210. For example, the upper edge of the blade 210 is an edge connected to a rotating shaft 216. The GPS 211 and the distance sensor 214 are fixedly arranged relative to the third bracket 2121 via the first bracket 213 and the second bracket 215, respectively. In some embodiments, the fixed connection mode between the first bracket 213, the second bracket 215 and the third bracket 2121 is a bolt fixed connection or a welding fixed connection. For example, the third bracket 2121 is a connecting plate. The length of the connecting plate can be set as needed.

Finally, the vertical distance between the GPS and the target position is acquired according to the vertical distance between the distance sensor and the target position and the vertical distance between the GPS and the distance sensor.

For example, in FIG. 2, the vertical distance $H_2$ between the GPS 211 and the target position B is a sum of $H_1$ and $L_1$.

In step S112, the elevation of the target position is acquired according to the elevation of the GPS and the vertical distance between the GPS and the target position. For example, in FIG. 2, the elevation $Z_B$ of the target position B is $Z_{GPS}-(H_1+L_1)$.

Returning to FIG. 1, the description of the step S110 is continued.

The process of acquiring the elevation of the current position of the blade of the motor grader in the step S110, shown in FIG. 1, will be described in detail below with reference to FIG. 5.

Figure 5:
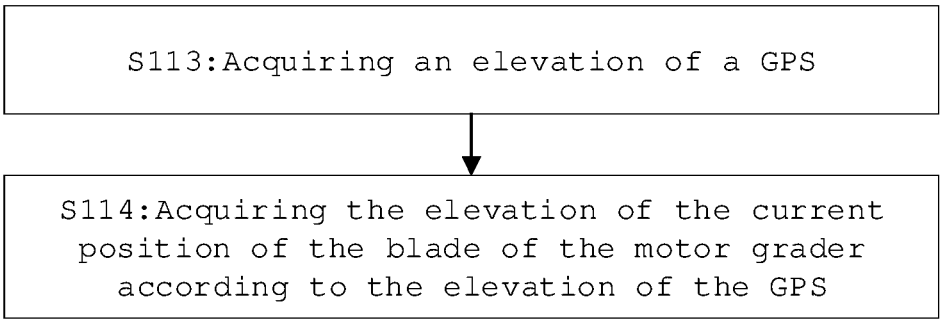
FIG. 5 is a flow chart illustrating acquiring an elevation of a current position of a blade of a motor grader according to some embodiments of the present disclosure.

FIG. 5 is a flow chart illustrating acquiring an elevation of a current position of a blade of a motor grader according to some embodiments of the present disclosure.

As shown in FIG. 5, that acquiring the elevation of the current position of the blade of the motor grader comprises steps S113-S114.

In step S113, the elevation of the GPS is acquired. For example, the elevation $Z_{GPS}$ of the GPS 211 in FIG. 2 is acquired.

In step S114, the elevation of the current position of the blade of the motor grader is acquired according to the elevation of the GPS.

For example, in FIG. 2 or 3*a*, the GPS 211 is located directly above the blade 210. The elevation of the current position of the blade of the motor grader is obtained according to the elevation of the GPS in the following manner.

First, the elevation of a projection point of the GPS on the ground is determined according to the distance between the GPS and the projection point of the GPS on the ground and the elevation of the GPS.

For example, in FIG. 2, the elevation of the GPS 211 is $Z_{GPS}$. A blade chord length of the blade 210 is $L_2$. The blade chord length of the blade 210 is a length of a vertical line segment between an upper edge and a lower edge of the blade 210. The lower edge of the blade is an edge close to the ground opposite the upper edge of the blade.

When the vertical line segment between the upper edge and the lower edge of the blade 210 is perpendicular to the ground, a position of any edge angle of the lower edge of the blade is a projection point of the GPS 211 on the ground. For example, in FIG. 2, a distance between the GPS 211 and a projection point C of the GPS 211 on the ground is a sum of the length $L_1$ of the first bracket and the blade chord length $L_2$ of the blade 210. The elevation $Z_C$ of the projection point C of the GPS 211 on the ground is $Z_{GPS}-(L_1+L_2)$.

Next, the elevation of the current position of the blade is determined according to the elevation of the projection point of the GPS on the ground and a shovel angle of the current position of the blade.

For example, in FIG. 2, the shovel angle of the current position A of the blade 210 is $\beta$. In some embodiments, in FIG. 3*a* or 3*b*, the blade 210 is coupled to the rotating shaft 216, and the blade 210 may be rotated clockwise or counterclockwise about the rotating shaft 216 to form the shovel angle shown in FIG. 2.

For example, in FIG. 2, an angle $\alpha$ of rotation of the blade from the projection point C to the current position A is $180-(90-\beta)\times 2$, i.e., $\alpha=2\beta$.

In some embodiments, a radius of rotation of the blade 210 is the blade chord length $L_2$. The blade chord length is a length of a vertical line segment between the upper edge and the lower edge of the blade. $L_2$ can be obtained by measurement.

For example, the elevation $Z_A$ of the current position A of the blade 210 is $z_C+(L_2-L_2\times\cos\alpha)$, i.e., $Z_A=Z_{GPS}-(L_1+L_2)+(L_2-L_2\times\cos(2\beta))$.

In some embodiments, there are a plurality of GPS. For example, in FIG. 3*b*, the GPS includes a first GPS 211*a* and a second GPS 211*b*. The first GPS 211*a* and the second GPS 211*b* are respectively located on both sides of the blade 210 in a width direction of a body of the motor grader. For example, in FIG. 3*b*, the first GPS 211*a* and the second GPS 211*b* are fixedly arranged relative to the third bracket 2121 via the first bracket 213*a* and the first bracket 213*b*, respectively.

In some embodiments, there comprise a plurality of distance sensors. For example, in FIG. 3*b*, the distance sensors include a first distance sensor 214*a* and a second distance sensor 214*b*. The first and second distance sensors 214*a* and 214*b* are separated apart from both sides by a certain horizontal distance, respectively, along the movement direction of the motor grader. The first distance sensor 214*a* and the first GPS 211*a* are both located on one sides of the both sides. The second distance sensor 214*b* and the second GPS 211*b* are both located on the other side of the both sides. For example, in FIG. 3*b*, the first and second distance sensors 214*a* and 214*b* are fixedly arranged relative to the third bracket 2121 via the second bracket 215*a* and the second bracket 215*b*, respectively.

Specific positions of the two GPS and the two distance sensors on both sides of the body in the width direction may be set as required.

For example, in this case, the current position includes a position of a first edge angle and a position of a second edge angle of the blade. For example, in FIG. 3*b*, the position of the first edge angle is 2101*a* and the position of the second edge angle is 2101*b*.

Returning to FIG. 1, the description of the step S110 is continued.

The step S110 of acquiring the movement speed of the motor grader is realized in the following manner for example.

In some embodiments, the movement speedy of the motor grader is acquired by a speed sensor arranged on any one wheel of the motor grader.

After the elevation of the current position of the blade of the motor grader, the elevation of the target position, and the movement speed of the motor grader are respectively acquired, the step S120 is continuously performed.

In the step S120, the movement time of the blade from the current position to the target position is determined according to the horizontal distance and the movement speed.

For example, in FIG. 2, the second bracket 215 has a length $L_3$. The shovel angle at the current position A of the blade 210 is β. As can be seen from the above calculation, the angle α of rotation of the blade from the projection point C to the current position A is 2β. Then, the horizontal distance L is $L_3+L_2\times\sin 2\beta$. In the case that the blade rotates clockwise, β takes a negative value. In the case that the blade rotates counterclockwise, β takes a positive value.

For example, the movement time t of the blade 210 from the current position A to the target position B in FIG. 2 is L/v, as can be learned from the physical kinematics.

In the step S130, the lifting speed of the lifting cylinder is determined according to an elevation difference between the elevation of the target position and the elevation of the current position and the movement time.

For example, in FIG. 2, the elevation $Z_B$ of the target position B is $Z_{GPS}-(H_1+L_1)$, and the elevation $Z_A$ of the current position A is $Z_{GPS}-(L_1+L_2)+(L_2-L_2\times\cos(2\beta))$. $Z_B-Z_A$ is the elevation difference. The elevation difference is positive, negative or 0.

As can be learned from the physics kinematics, lifting cylinders 217*a* and 217*b* in FIG. 3*a* both have a lifting speed of $(Z_B-Z_A)\div(L/v)$. The lifting speed is positive, negative or 0 corresponding to the elevation difference.

In FIG. 3*b*, the lifting speed of the first lifting cylinder 217*a* and the lifting speed of the second lifting cylinder 217*b* may be separately determined using a similar calculation process.

In the step S140, the lifting cylinder is controlled to adjust the blade to move from the current position to the target position according to the lifting speed.

For example, under the condition that the lifting speed is positive, the target position is higher than the current position, and the lifting cylinder is controlled to adjust the blade to rise from the current position according to the lifting speed so as to reach the target position. Under the condition that the lifting speed is negative, the target position is lower than the current position, and the lifting cylinder is controlled to adjust the blade to fall from the current position according to the lifting speed so as to reach the target position.

Figure 6:
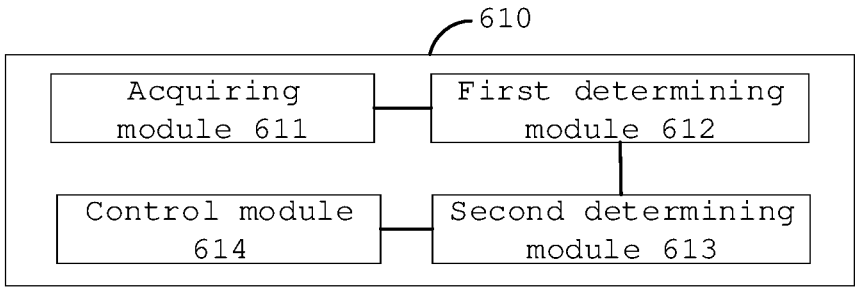
FIG. 6 is a block diagram illustrating a leveling control device according to some embodiments of the present disclosure.

FIG. 6 is a block diagram illustrating a leveling control device according to some embodiments of the present disclosure.

As shown in FIG. 6, the leveling control device 610 comprises an acquiring module 611, a first determining module 612, a second determining module 613, and a control module 614.

The acquiring module 611 is configured to acquire an elevation of a current position of a blade of a motor grader, an elevation of a target position, and a movement speed of the motor grader, for example, to perform the step S110 shown in FIG. 1. The target position is on the ground with a certain horizontal distance from the current position along a movement direction of the motor grader.

The first determining module 612 is configured to determine a movement time of the blade from the current position to the target position according to the horizontal distance and the movement speed, for example, to perform the step S120 shown in FIG. 1.

The second determining module 613 is configured to determine a lifting speed of a lifting cylinder according to an elevation difference between the elevation of the target position and the elevation of the current position and the movement time, for example, to perform the step S130 shown in FIG. 1.

The controlling module 614 is configured to control the lifting cylinder to adjust the blade to move from the current position to the target position according to the lifting speed, for example, to perform the step S140 shown in FIG. 1.

Figure 7:
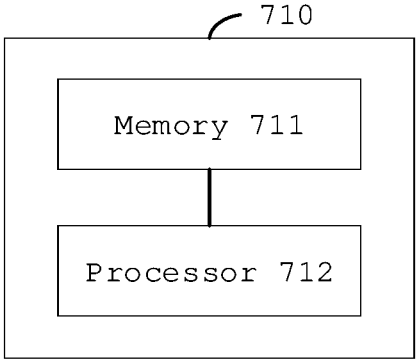
FIG. 7 is a block diagram illustrating a leveling control device according to some other embodiments of the present disclosure.

FIG. 7 is a block diagram illustrating a leveling control device according to some other embodiments of the present disclosure.

As shown in FIG. 7, the leveling control device 710 comprises a memory 711; and a processor 712 coupled to the memory 711. The memory 711 is configured to store instructions for performing respective embodiments of the leveling control method. The processor 712 is configured to perform the leveling control method in any of the embodiments of the present disclosure based on the instructions stored in the memory 711.

Figure 8:
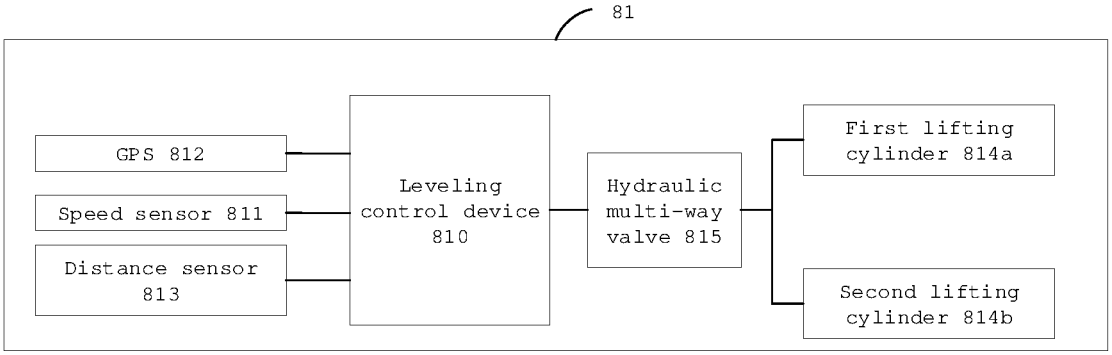
FIG. 8 is a block diagram illustrating a leveling control system according to some embodiments of the present disclosure.

FIG. 8 is a block diagram illustrating a leveling control system according to some embodiments of the present disclosure.

As shown in FIG. 8, the leveling control system 81 comprises a leveling control device 810. For example, the leveling control device 810 is similar in structure to the leveling control device 610 or the leveling control device 710 in the present disclosure. In some embodiments, the leveling control device is a controller.

In some embodiments, the leveling control system 81 further comprises a speed sensor 811, a GPS 812, and a distance sensor 813.

The speed sensor 811 is arranged on any wheel of the motor grader. The speed sensor 811 is configured to measure a movement speed of the motor grader. For example, the speed sensor 811 is coupled to the leveling control controller 810 through a communication cable or communication protocol.

The GPS 812 is fixedly arranged relative to a frame of the motor grader. The GPS 812 is configured to measure an elevation of the GPS. The distance sensor 813 is fixedly arranged relative to the frame of the motor grader. The distance sensor 813 is configured to detect the ground to get a detection value. For example, the GPS 812 and the distance sensor 813 are coupled to the leveling control device 810 through a communication cable or a communication protocol.

In some embodiments, the leveling control system 81 further comprises a first lifting cylinder 814*a* and a second lifting cylinder 814*b*. The first and second lifting cylinders 814*a* and 814*b* are configured to adjust the elevation of the position of the first and second edge angles of the blade, respectively. For example, the first and second lifting cylinders 814*a* and 814*b* are left and right lifting cylinders of the motor grader, respectively.

In some embodiments, the leveling control system 81 further comprises a hydraulic multi-way valve 815. The leveling control device 810 controls the first and second lifting cylinders 814*a* and 814*b* through the hydraulic multi-way valve 815 to adjust the blade to move from the current position to the target position according to the calculated lifting speed.

For example, the present disclosure further proposes a motor grader. The motor grader comprises the leveling control system according to any of the embodiments of the present disclosure. For example, the leveling control system is similar in structure to the leveling control system 81 of the present disclosure.

Figure 9:
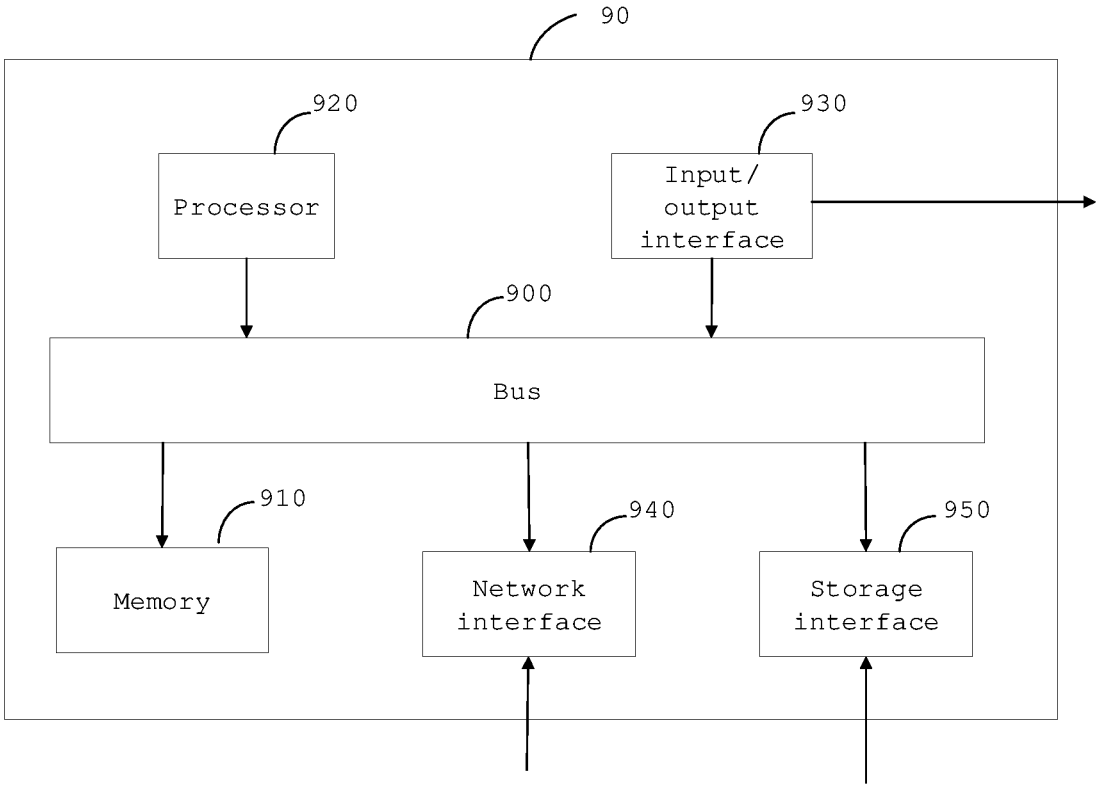
FIG. 9 is a block diagram illustrating a computer system for implementing some embodiments of the present disclosure.

FIG. 9 is a block diagram illustrating a computer system for implementing some embodiments of the present disclosure.

As shown in FIG. 9, the computer system 90 may take the form of a general purpose computing device. The computer system 90 comprises a memory 910, a processor 920, and a bus 900 that couples various system components.

The memory 910 may include, for example, a system memory, a non-volatile storage media, and the like. The system memory stores, for example, an operating system, an application program, a Boot Loader, and other programs. The system memory may include volatile storage media, such as Random Access Memory (RAM) and/or cache memory. The non-volatile storage medium, for instance, stores instructions to perform respective embodiments of at least one of the leveling control methods. The non-volatile storage medium includes, but is not limited to, magnetic disk storage, optical storage, flash memory, and the like.

The processor 920 may be implemented as discrete hardware components, such as a general purpose processor, a Digital Signal Processor (DSP), an Application Specific Integrated Circuit (ASIC), a Field Programmable Gate Array (FPGA) or other programmable logic device, discrete gates or transistors, or the like. Accordingly, each of the modules such as the judging module and the determining module may be implemented by a Central Processing Unit (CPU) executing instructions in the memory to perform the corresponding steps, or may be implemented by a dedicated circuit to perform the corresponding steps.

The bus 900 may use any of a variety of bus structures. For example, the bus structures include, but are not limited to, Industry Standard Architecture (ISA) bus, Micro Channel Architecture (MCA) bus, and Peripheral Component Interconnect (PCI) bus.

The computer system 90 can further include input/output interface 930, network interface 940, storage interface 950, and the like. The interfaces 930, 940, 950, as well as the memory 910 and the processor 920, may be coupled by the bus 900. The input/output interface 930 may provide a connection interface for input/output devices such as a display, a mouse, a keyboard, and the like. The network interface 940 provides a connection interface for a variety of networking devices. The storage interface 950 provides a connection interface for external storage devices such as a floppy disk, a USB disk, and an SD card.

Various aspects of the present disclosure are described herein with reference to flowcharts and/or block diagrams of the methods, devices and computer program products according to the embodiments of the present disclosure. It should be understood that each block of the flowcharts and/or block diagrams, and combinations of the blocks, can be implemented by computer-readable program instructions.

These computer-readable program instructions may be provided to a processor of a general purpose computer, a special purpose computer, or other programmable apparatus to produce a machine, such that the instructions, which when executed by the processor, create means for implementing the functions specified in one or more blocks of the flowchart and/or block diagram.

These computer readable program instructions may also be stored in a computer-readable memory that can direct a computer to function in a particular manner, so as to produce an article of manufacture, including instructions for implementing the functions specified in one or more blocks of the flowchart and/or block diagram.

The present disclosure may take the form of an entirely hardware embodiment, an entirely software embodiment or an embodiment combining software and hardware aspects.

By means of the leveling control method, device and system, the motor grader and the computer storable medium in the above embodiments, the leveling accuracy is improved.

Thus far, the leveling control method, device and system, the motor grader, the computer storable medium according to the present disclosure have been described in detail. Some details well known in the art have not been described in order to avoid obscuring the concepts of the present disclosure. Those skilled in the art would fully know how to implement the technical solutions disclosed herein, according to the above description.

What is claimed is:

1. A leveling control method, performed via a leveling control device, comprising:

respectively acquiring an elevation of a current position of a blade of a motor grader, an elevation of a target position, and a movement speed of the motor grader, wherein the target position is on the ground with a certain horizontal distance from the current position along a movement direction of the motor grader;

determining a movement time of the blade from the current position to the target position according to the horizontal distance and the movement speed;

determining a lifting speed of a lifting cylinder according to an elevation difference between the elevation of the target position and the elevation of the current position and the movement time; and controlling the lifting cylinder to adjust the blade to move from the current position to the target position according to the lifting speed, wherein the acquiring an elevation of a target position comprises: respectively acquiring an elevation of a Global Positioning System (GPS) and a vertical distance between the GPS and the target position, wherein the GPS is fixedly arranged relative to a frame of the motor grader, and acquiring the elevation of the target position according to the elevation of the GPS and the vertical distance between the GPS and the target position.

2. The leveling control method according to claim 1, wherein acquiring a vertical distance between the GPS and the target position comprises:

acquiring a vertical distance between a distance sensor and the target position, wherein the distance sensor is fixedly arranged relative to the frame of the motor grader;

acquiring a vertical distance between the GPS and the distance sensor; and acquiring the vertical distance between the GPS and the target position according to the vertical distance between the distance sensor and the target position and the vertical distance between the GPS and the distance sensor.

3. The leveling control method according to claim 2, wherein the distance sensor is located directly above the target position, and acquiring a vertical distance between a distance sensor and the target position comprises:

acquiring a detection value obtained by the distance sensor through detecting the ground; and acquiring the vertical distance between the distance sensor and the target position according to the detection value.

4. The leveling control method according to claim 3, wherein the distance sensor is an ultrasonic sensor or a lidar sensor, and the acquiring the vertical distance between the distance sensor and the target position according to the detection value comprises:

determining the detection value as the vertical distance between the distance sensor and the target position in the case that the distance sensor is the ultrasonic sensor; and determining a product of the detection value and a cosine value of a laser emission angle of the lidar sensor as the vertical distance between the distance sensor and the target position in the case that the distance sensor is the lidar sensor.

5. The leveling control method according to claim 1, wherein acquiring an elevation of a current position of a blade of a motor grader comprises:

acquiring an elevation of a Global Positioning System (GPS), wherein the GPS is fixedly arranged relative to a frame of the motor grader; and acquiring the elevation of the current position of the blade of the motor grader according to the elevation of the GPS.

6. The leveling control method according to claim 5, wherein the GPS is located directly above the blade, and the acquiring the elevation of the current position of the blade of the motor grader according to the elevation of the global positioning system (GPS) comprises:

determining an elevation of a projection point of the GPS on the ground according to a distance between the GPS and the projection point of the GPS on the ground and the elevation of the GPS; and determining the elevation of the current position of the blade according to the elevation of the projection point of the GPS on the ground and a shovel angle of the current position of the blade.

7. The leveling control method according to claim 1, wherein the current position comprises a position of a first edge angle and a position of a second edge angle of the blade, respectively.

8. A leveling control device, comprising:

a memory; and a processor coupled to the memory, the processor configured to perform the leveling control method according to claim 1 based on instructions stored in the memory.

9. A leveling control system comprising the leveling control device according to claim 8.

10. The leveling control system according to claim 9, further comprising:

a speed sensor arranged on any wheel of the motor grader and configured to measure a movement speed of the motor grader; and a Global Positioning System (GPS) fixedly arranged relative to a frame of the motor grader and configured to measure an elevation of the GPS; and a distance sensor fixedly arranged relative to a frame of the motor grader and configured to detect the ground to get a detection value.

11. The leveling control system according to claim 10, wherein the GPS and the distance sensor are fixedly arranged relative to the frame of the motor grader by a first bracket and a second bracket, respectively.

12. The leveling control system according to claim 11, wherein the GPS is located directly above the blade, and the distance sensor is spaced apart from the blade by a certain distance along the movement direction of the motor grader.

13. The leveling control system according to claim 11, wherein the first bracket is perpendicular to a horizontal plane and the second bracket is parallel to the horizontal plane.

14. The leveling control system according to claim 12, wherein:

the GPS comprises a first GPS and a second GPS, respectively located directly above the blade on both sides in a width direction of a body of the motor grader; and the distance sensor comprises a first distance sensor and a second distance sensor, respectively spaced apart from the both sides along the movement direction of the motor grader by a certain distance, and the first distance sensor and the first GPS are both located on one side of the both sides, and the second distance sensor and the second GPS are both located on the other side of the both sides.

15. A motor grader comprising the leveling control system according to claim 9.

16. A non-transitory computer storable medium having stored thereon computer program instructions which, when executed by a processor, implement the leveling control method according to claim 1.

17. A leveling control device, comprising:

an acquiring module configured to respectively acquire an elevation of a current position of a blade of a motor grader, an elevation of a target position, and a movement speed of the motor grader, wherein the target position is on the ground with a certain horizontal distance from the current position along a movement direction of the motor grader;

a first determining module configured to determine a movement time of the blade from the current position to the target position according to the horizontal distance and the movement speed;

a second determining module configured to determine a lifting speed of a lifting cylinder according to an elevation difference between the elevation of the target position and the elevation of the current position and the movement time; and a controlling module configured to control the lifting cylinder to adjust the blade to reach the target position from the current position according to the lifting speed, wherein the acquiring an elevation of a target position comprises: respectively acquiring an elevation of a Global Positioning System (GPS) and a vertical distance between the GPS and the target position, wherein the GPS is fixedly arranged relative to a frame of the motor grader, and acquiring the elevation of the target position according to the elevation of the GPS and the vertical distance between the GPS and the target position.

* * * * *